US007644675B1

(12) United States Patent
Ha

(10) Patent No.: US 7,644,675 B1
(45) **Date of Patent: *Jan. 12, 2010**

(54) LATERAL THRUSTER UNIT FOR MARINE VESSELS

(76) Inventor: Don Dongcho Ha, 404 E. First St., #607, Long Beach, CA (US) 90802

( * ) Notice: Subject to any disclaimer, the term of this patent is extended or adjusted under 35 U.S.C. 154(b) by 0 days.

This patent is subject to a terminal disclaimer.

(21) Appl. No.: 12/384,744

(22) Filed: Apr. 8, 2009

(51) Int. Cl.
*B63H 1/16* (2006.01)

(52) U.S. Cl. ..... 114/151; 440/62

(58) Field of Classification Search ..... 114/151; 440/53, 62, 67

See application file for complete search history.

(56) References Cited

U.S. PATENT DOCUMENTS 3,053,489 A * 9/1962 Robinson et al. ..... 248/642
4,732,104 A * 3/1988 Roestenberg ..... 114/151
5,306,183 A * 4/1994 Holt et al. ..... 440/6
5,383,802 A * 1/1995 Nicholson ..... 440/38
5,435,763 A * 7/1995 Pignata ..... 440/67
6,964,590 B1 * 11/2005 Ha ..... 440/67

* cited by examiner

*Primary Examiner*—Ed Swinehart

(57) ABSTRACT

A thruster unit for generating side thrust for improved maneuverability of a marine vessel employs a peripherally-driven propeller situated below the waterline and remotely powered by a motor situated above the waterline via a flexible drive member. The propeller is supported by a rolling element bearing disposed circumferentially around the outer perimeter of the propeller providing both axial and radial support. The lower portion disposed for submerged operation has a substantially thin cross section with a narrow thickness aligned transversely to the vessel to operate hydro-dynamically while the vessel is underway. This makes it possible for the present invention to remain in the operating position indefinitely even while the vessel is in motion without risking a structural damage. The thruster unit can be installed on the vessel using a hinged bracket assembly such that during the extended periods while the vessel is not operating the thruster unit may be pivoted out from the water for dry storing, safely away from the corrosion, marine growth, or any other harmful effect of the water.

2 Claims, 8 Drawing Sheets

LATERAL THRUSTER UNIT FOR MARINE VESSELS

BACKGROUND OF THE INVENTION

1. Technical Field

This invention relates to a lateral thruster unit externally mounted at the bow, the stern, or the swim platform of a marine vessel for improving the slow speed maneuvering thereof, more particularly to such thruster unit which is capable of remaining in the operating position while the vessel is in motion without incurring a structural damage.

2. Description of the Related Art

The maneuvering of a vessel in close quarters as during docking and undocking is often challenging using only the vessel's main propulsion and steering systems. It is especially difficult for those vessels equipped with an inboard engine with a single screw propulsion system and steered by an ordinary rudder. In most cases, the rudders are configured for optimum performance within the structurally acceptable limits for the maximum operating speed intended for the vessel, and as a result, are often insufficient for adequate steering control at slow speeds. The problem is compounded by the presence of a paddle-wheel phenomenon pronouncedly noticeable with such inboard single screw vessels, wherein the prop-wash created by the rotating propeller generates a swirling movement in the water below the hull to cause the stern of the vessel to drift sideways. In the case of a clockwise rotating propeller as viewed toward the bow, this phenomenon causes the stern of the vessel to tend to drift toward the starboard side while traversing forward and toward the port side while in reverse. The effect is opposite with a counter-clockwise rotating propeller. The steering control at slow speeds may prove further challenging if there is any prevailing wind or current condition which may cause the bow and/or stern of the vessel to veer off from the intended course in an unpredictable manner. As a result of all of these, a vessel with an inboard engine and with single screw propulsion system therefore is known to have a very little steering control while traversing forward at a slow speed and a little or no steering control at all while traversing in reverse.

A vessel with other types of propulsion and steering systems, such as those with an outboard engine or an outdrive system as commonly used in many small modern pleasure and fishing crafts have the ability to adjust the propeller thrust direction via steering control input. That is, by pivoting the rotating axis of the propeller about the vertical axis, a lateral component in the propeller thrustline may be created which will enable the vessel to be steered even at a slow speed and while moving forward or rearward. Also, a vessel with a counter-rotating twin-screw propulsion system as commonly found in many larger pleasure and commercial vessels have the ability to independently control the thrust direction of each of the two propellers. By operating one propeller in the forward direction and the other in reverse, the vessel may be rotated about a vertical axis even without any substantial longitudinal movement of the vessel. Thus, vessels incorporating these types of propulsion systems are inherently more maneuverable. However, piloting even these types of vessels in close quarters, especially the larger of these, many be challenging to all but the most experienced helmsmen, especially with presence of unfavorable wind and/or current conditions.

There are various prior art examples aimed at enhancing the slow speed maneuverability of a vessel, however, the most common commercially available involves an internally mounted bow thruster system. The internal bow thruster systems, as based on such prior arts of Aron, Denston, and Kuss, comprise a thruster unit mounted within a transverse ducting installed at the bow section of a vessel below the waterline connecting the port and starboard sides of the hull. The thruster unit is powered by an electric or a hydraulic motor to drive a single or a multiple propellers coaxially positioned within the tube to induce water flow in the transverse axis of the hull. Such thruster unit may also be mounted within a transverse ducting similarly installed at the stern section of a vessel to create the stern thruster system. The bow or stern thrusters normally remain unused, except only while slow speed maneuvering. The bow and stern thruster systems may be operated independently or simultaneously in opposing directions to cause the vessel to rotate about a vertical axis, or simultaneously in the same direction to cause the vessel to laterally traverse.

There are many problems associated with an internally mounted bow or stern thruster system. First, these are costly to install. The installation requires a major below-the-waterline structural modification to the hull of the vessel to incorporate the ducting, which must be performed while the vessel is dry-docked and by a skilled hand. There are various models of such thruster units currently available in the after-market. However, the complexity and the cost involved with the installation of such are beyond the means of most pleasure vessel owners, and therefore, the use and the benefits of these devices are generally reserved only for the larger and expensive pleasure yachts or commercial vessels.

Second, the installation of the internal thruster unit potentially risks the degradation in the structural integrity in the bow and/or stern sections of the vessel. The weakened structure may develop a failure as a result of navigating through the rough waters or from light bumps or collision with other vessels or the dock structure which otherwise may have been non-detrimental to a hull which had not been so modified.

Third, a structural crack or any failure in the below-the-waterline seal joint, including those seal joints integral to the thruster unit mechanism, will results in the water ingestion aboard the vessel. The leakage aboard may take place while the operator is unaware, and if the rate of such leakage is greater than the rate at which the vessel's overboard pump system is able to discharge overboard the vessel may sink.

Fourth, the ducting will incur marine growth and, unless costly maintenance is performed regularly, result in reduced performance of the thruster system. With the vessel at dock, the cleaning may be performed only by accessing from a duct opening from either side of the hull. The access to clean the interior of the ducting and the gearbox portion of the drive unit within the ducting is difficult, because the accessibility thereto is inhibited by the propeller(s) and the narrowness of the passageway within the ducting. For similar reasons, the maintenance repair is costly. For maintenance operations requiring the removal of the thruster unit from the vessel, either the vessel must first be hauled out of the water and dry-docked, or if the operation must be performed while at dock, special tooling, preparation, and technique will be required to properly seal off all of the openings below the waterline prior to detaching the thruster unit from the ducting.

Fifth, because holes are created on both sides of the bow due to the ducting, the hydrodynamic effects reacting against the discontinuous surfaces on either side of the hull will generate resistance, and thus reduces the operating efficiency of the vessel.

Finally, yet importantly, the internally mounted system detracts from a valuable and limited usable onboard space within the hull.

Some prior art devices, such as of Wardell and Van Breems address some of the concerns dealing with the internally mounted thruster, especially with one regarding the reduced performance due to the hydro-dynamic resistance, by employing a system of mechanisms for retracting and stowing the thruster unit to within the hull cavity while it is being unused. The Van Breems further addresses the maintainability concern by making a detachable thruster unit, which may be easily removed from the vessel from the surface of the deck. However, both of these devices still have the disadvantages of costly hull modification and installation, possible reduction in the structural integrity of the hull, and mechanical complexity resulting from the incorporation of the retracting system.

The prior art of Roestenberg is an externally mounted pivotal bow thruster. This device is advantageous over the others in that it may easily be installed from above the waterline and without a major modification made to the hull of the vessel, and thus it is possible for a moderately skilled user to self-install the device using only ordinary tools. The device also has an advantage of incorporating a pivotal retracting mechanism, which stows the thruster unit out of the water while the vessel is cruising, and therefore preventing any degraded vessel performance due to the hydrodynamic resistance caused by the drive unit. In addition, the maintenance of the device may be performed easily as the entire drive unit and the pivotal actuator assembly may be detached from the vessel. However, the drawback of the Roestenberg is mechanical complexity and delicate nature of the pivotal retracting mechanism, which may easily incur damage while the vessel is navigating through rough waters.

Similarly, the prior art of Pinsof presents an externally mounted stern thruster adapted for mounting on the transom or on the swim platform attached to the transom in a typical small powered vessel. The installation is performed above the waterline and without a major modification performed to the hull of the vessel, and thus, this enables a moderately skilled user to self-install the device using only ordinary tools. However, the Pinsof's stern thruster has a disadvantage of mechanical complexity associated with the linear or rotary deployment and retracting mechanism employed thereby.

While Wardell, Van Breems, Roestenberg, and Pinsof all cite the advantages of incorporating retractability feature to their thruster systems, it is noted that there are also disadvantages associated with the same. The operator must first deploy the thruster unit to the submerged operating position prior to energizing the device. A sustained dry operation of the thruster while the thruster unit is out of the water may lead to premature failures of the drive shaft seal(s) or the motor. In addition, the operator must retract the thruster unit out of the water prior to commencing high-speed cruise, or the hydrodynamic forces may cause damages to the drive unit and its support structure. It is possible to exclusively interlock the deployment and energization of the thruster unit by using position sensors and such, and similarly, to have the retracting operation interlocked with the vessel's instrumentation, so that it automatically retracts when a preprogrammed vessel speed is reached. However, incorporating such safety features will increase complexity and cost and decrease the overall reliability of the thruster system.

BRIEF SUMMARY OF THE INVENTION

This invention addresses the concerns and deficiencies as descried above associated with the prior art and presents an improved bow or stern thruster system. Accordingly, it is an objective of the present invention to provide a simple yet reliable self-contained thruster unit which may be easily installed without requiring the vessel to be hauled out of the water.

It is also an objective of the present invention to provide a bow or a stern thruster system with a mounting means for installing the thruster unit at the bow, the stern, or the swim platform of a marine vessel.

It is another objective of the present invention to provide a thruster system with a mounting means which allows the thruster unit to be pivoted out from the water to be stored dry and away from marine growth, corrosion, and other harmful effects caused by the water.

It is a further objective of the present invention to provide a thruster unit with a substantially thin and streamlined lower portion situated below the waterline with the motor situated well above the waterline to minimize hydrodynamic resistance while the vessel is in motion and such thruster capable of remaining indefinitely in the operating position while the vessel is in motion without risking any structural damage.

It is still a further objective of the present invention to provide a thruster unit, which may be cleaned easily using only ordinary implements and without special preparations to or partial disassembly nor removal of the drive unit from the hull of the vessel.

It is yet another objective of the present invention to provide a thruster unit which is easily detachable from the hull of the vessel for performing any required servicing and subsequently easily reattachable.

It is yet a further objective of the present invention to conserve useable and valuable space in or on the vessel.

These and other objectives are attained by the present invention, which is adapted for attachment on a vessel entirely from the exterior and from above the waterline. The installation is performed using simple tools and with ordinary skills, and in most cases, while the vessel is at dock. The only modifications necessary to the vessel are drilling of small holes above the waterline for attachment of the mounting bracket, and thus there is no concern for water leakage nor weakening of the structural integrity as associated with the installation of most of the prior art examples earlier described.

The thruster unit of the present invention is packaged into a self-contained unit with all of the drive components thereof housed within a tough casing and is structurally supported securely onto the vessel by a set of brackets. Unlike most prior art examples wherein the propeller(s) is/are coaxially and directly mounted to the output shaft of the motor or of the gearbox, the drive system of the present invention utilizes a flexible drive belt, which mechanically couples the motor situated at the upper end of the casing to the peripherally-driven propeller situated at the opposite lower end. Such remote coupling arrangement has an advantage of having the motor positioned out of the water for improved protection from the harmful effects thereof. Another advantage is that it is possible to configure the lower submerged portion of the thruster that has a thin cross section along the transverse axis with a width of substantially 1.5 inches or less and is longitudinally streamlined to enable it to efficiently cut through the water with a minimum resistance. Such hydro-dynamically efficient design thus renders the thruster unit of the present invention a capability to remain indefinitely in the operating position on a vessel without risking a structural damage due to the hydrodynamic forces generated while the vessel is in motion. Compared with all of the prior art examples cited, the capability for indefinitely remaining in the operating position in combination with the external, above-the-waterline installation, renders the present invention much less complicated, more reliable, easier to install, easier to use, and more conserving of the space in or on the vessel.

For bow mounting, a bracket may be adapted to fit the contour of the stem. There are wide ranges of shapes and sizes which define the stem of the bow among various vessels. The angle at which the silhouette of the bow is measured from the waterline is diverse as well as the included angle between the two sides of the hull where they are joined at the stem. A bracket may be made from sheet metal or molded plastic to give it a necessary ductility and/or elasticity to enable these to conform to the stem contours within a reasonable range. Several of such brackets of different ranges of adaptability may be employed to cover a wider range of vessel stem contours and service most vessels.

The present invention may also be installed on the transom of any vessel having one, by employing a bracket adapted to fit the contour of the transom of any individual vessel. The transoms in most vessels are substantially flat, and thus adapting a bracket to fit thereto would be relatively easy.

Additionally, the present invention may be installed on a swim platform of any vessel having one. Many vessel designs include a substantially flat area at the stern to be used by the boaters for easy entrance to and from the water and for boarding and unboarding the vessel at dock. The thruster unit may be attached to a hinged bracket assembly and the bracket assembly positioned and pivotally attached on the flat surface of the swim platform such that the lower portion of the thruster is submerged under water in the normal operating position. Most pleasure boats are kept at dock non-operating for extended periods of time between the days of boating. During these periods of extended non-operation, the bracket assembly may be pivoted up and thereby bringing the thruster unit out of the water. The thruster unit may then be stored up on top of the swim platform safely away from the marine growth, galvanic corrosion, or any other harmful effects which otherwise would inflict on the thruster unit if it was kept submerged for extended period of time.

Where swim platform mounting provides an ideal application for the hinged bracket by providing a storage area for the thruster unit while it is pivoted out of the water, a similar approach is also adaptable with the bow and transom mounting brackets. A hinged assembly may be incorporated into the bow and transom mounting brackets to enable the thruster unit to be pivoted out from the water and secured in a non-operating position. The thruster unit may be tethered to a cordage means in such a position during the extended periods of non-operation.

The thruster unit of the present invention is attached to each of the above bracket assemblies using a set of ordinary screws. This enables a quick and easy removal of the thruster unit from the vessel for servicing and for a vessel-to-vessel transfer. The bracket assembly remains attached to the vessel with the adjustments intact, such that it allows a quick and easy subsequent reinstallation of the thruster unit.

The following illustrative drawings and detailed description make the foregoing and other objects, features, and advantages of the invention more apparent.

DETAILED DESCRIPTION OF THE INVENTION

Figure 1:
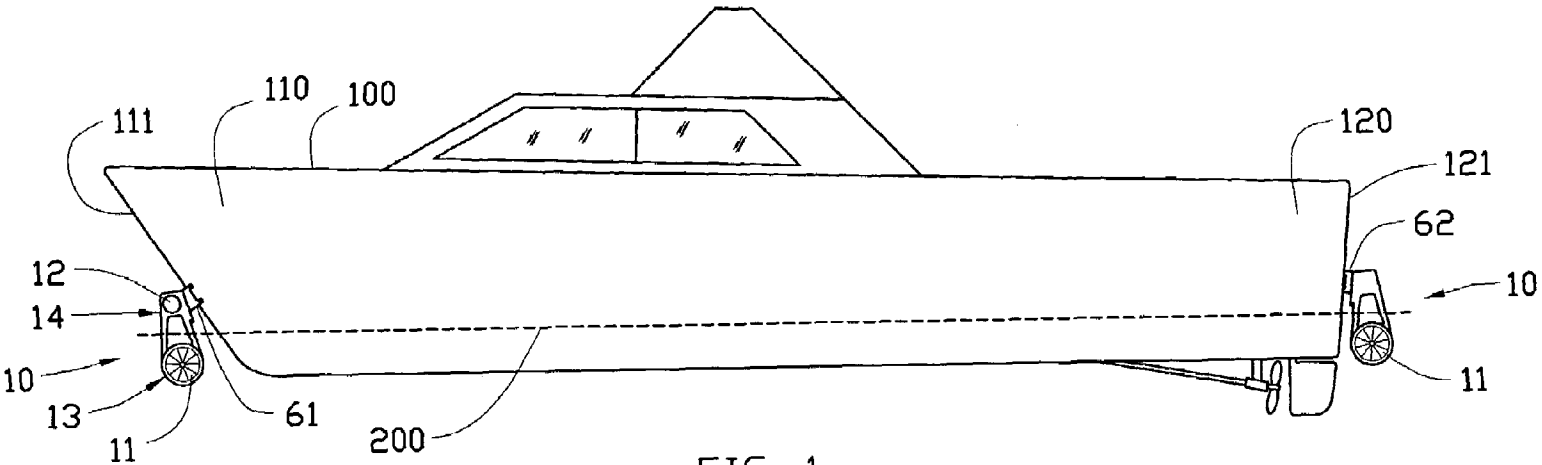
FIG. 1 of the drawings is an elevation view of a modern powered vessel with the thruster unit of the present invention fixedly installed on the stem and on the transom.
Figure 2:
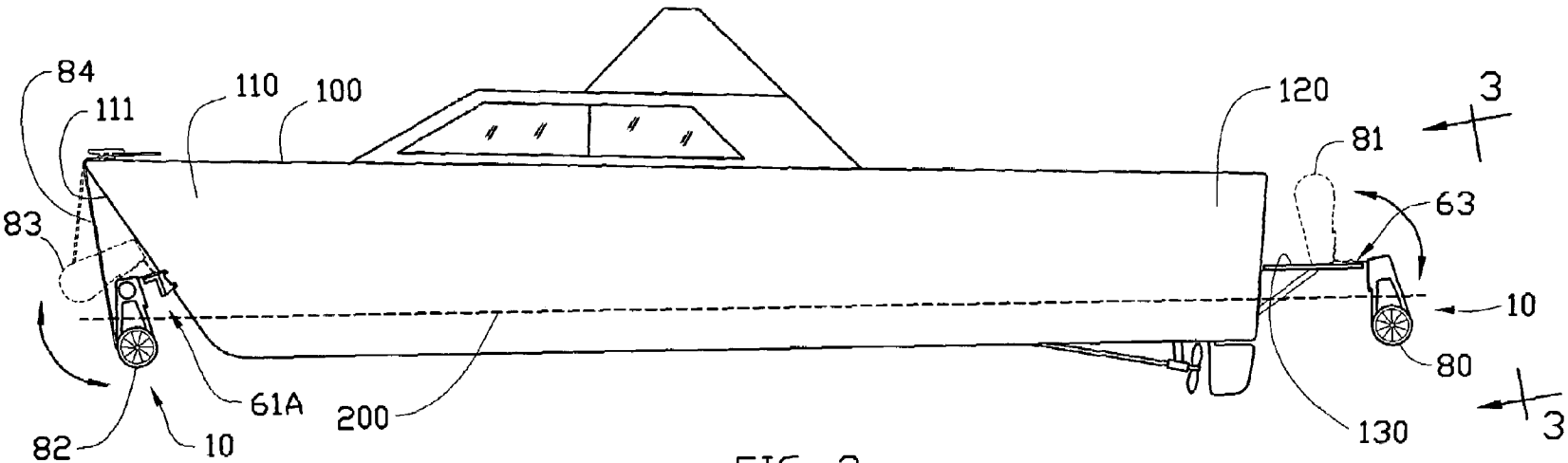
FIG. 2 is an elevation view of a modern vessel with a swim platform and the thruster unit of the present invention hingedly installed thereon and also hingedly installed on the stem.

FIGS. 1-10 of the drawing illustrate various aspects of a thruster unit 10 constructed according to the present invention. Referring to FIG. 1, a vessel 100 is illustrated with the thruster unit of the present invention 10 mounted on the stem 111 at the bow 110 and on the transom 121 at the stern 120 thereof. The illustrated vessel in FIG. 1 is a typical modern powered watercraft in the 25-30 feet range with an inboard-engine-driven single screw propulsion system with an ordinary rudder for steering. However, as already mentioned, the thruster unit 10 of the present invention may be conveniently installed about the stem and/or on the transom of any kind and size of vessel. The present invention is equally adaptable for mounting onto a vessel with a swim platform 130 or any substantially horizontal area extending rearward of stern as shown in FIG. 2.

FIG. 1 shows the thruster unit 10 fixedly mounted in a normal, installed position with respect to the vessel with the lower portion 13 of the thruster unit situated below the waterline 200 to ensure the propeller 11 is fully submerged. At the opposing extremity on the upper portion 14 of the thruster unit is an electric or hydraulic motor 12, which is maintained above the waterline. Compared with most of the prior art examples listed in the References Cited, of Aron, Denston, Kuss, Medynski, Pinsof, Roestenberg, and Van Breems, wherein the propeller(s) is/are coaxially and directly mounted on the output shaft of the motor or the gearbox, the unique architecture of the present invention, wherein the submerged propeller 11 is peripherally driven by the power source 12 which is situated away from and above the waterline 200, makes it possible for the submerged lower portion 13 to have a substantially thin cross section with a narrow thickness along the transverse axis of the vessel. This renders the thruster unit of the present invention hydro-dynamically efficient and low resistance generating. In the preferred embodiment, the transverse thickness, t, shown in FIG. 3 across the narrow section of the submerged portion 13 is approximately 1.5 inches.

Figure 3:
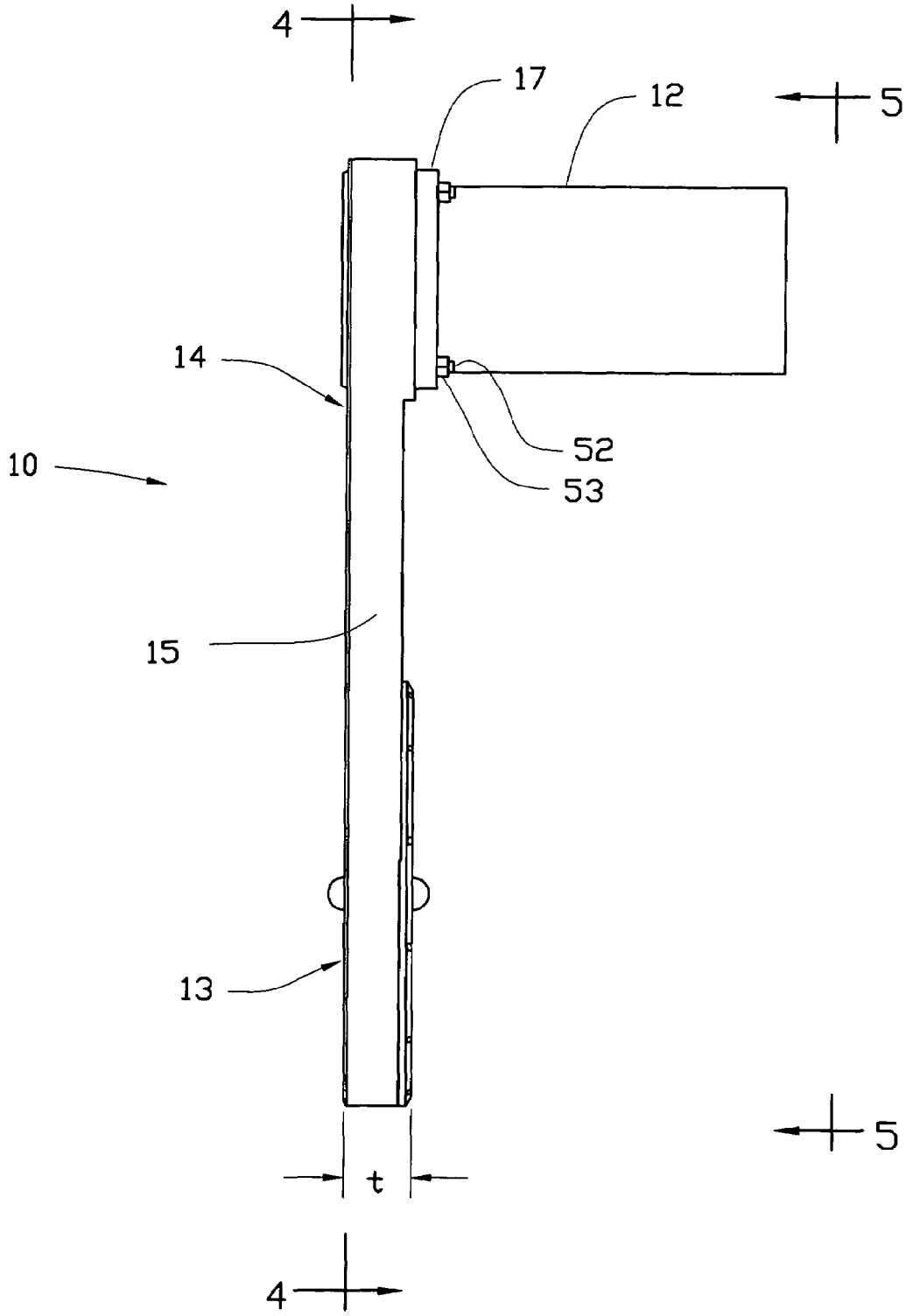
FIG. 3 shows the thruster unit of the present invention as viewed in the direction 3-3 established in FIG. 2 with the hinged bracket shown omitted for clarity.

Now, referring to FIG. 3 of the drawing, the thruster unit 10 comprises a casing 15 which provides a support foundation for a motor mount block 17 and the motor 12 mounted thereon.

Figure 4:
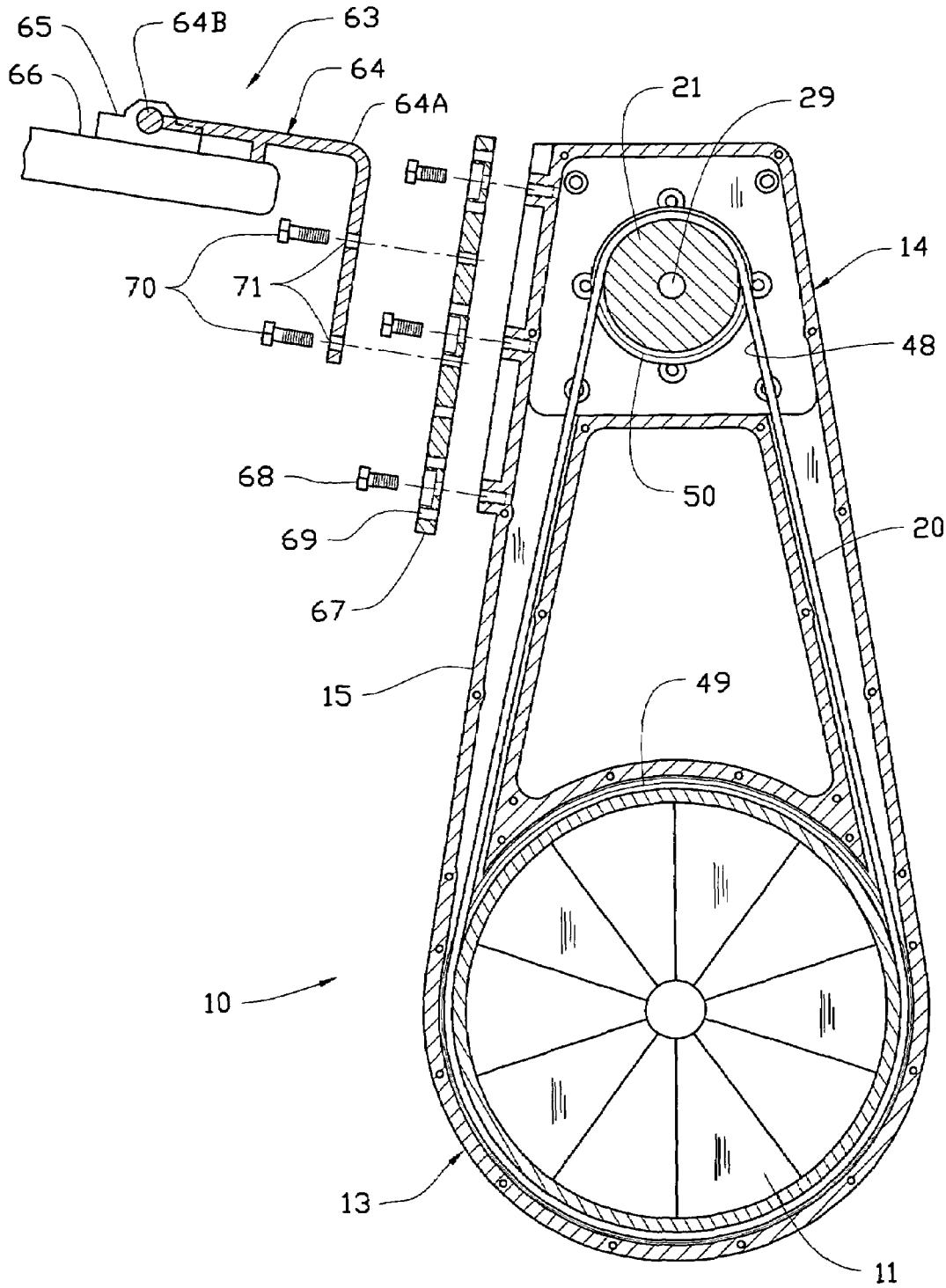
FIG. 4 is a partial cross section of the thruster unit of the present invention as viewed along the section plane 4-4 and in the direction established in FIG. 3. The swim platform mounting bracket is shown separated from and adjacent to the thruster unit for clarity.

Referring to FIG. 4 of the drawing, within the interior of the casing 15 are a drive pulley 21, a drive belt 20, and a propeller 11, wherein the drive pulley is affixed to the shaft 29 of the motor 12 to impart the torque generated by the motor to the drive belt to further transmit the power to the propeller.

Figure 7:
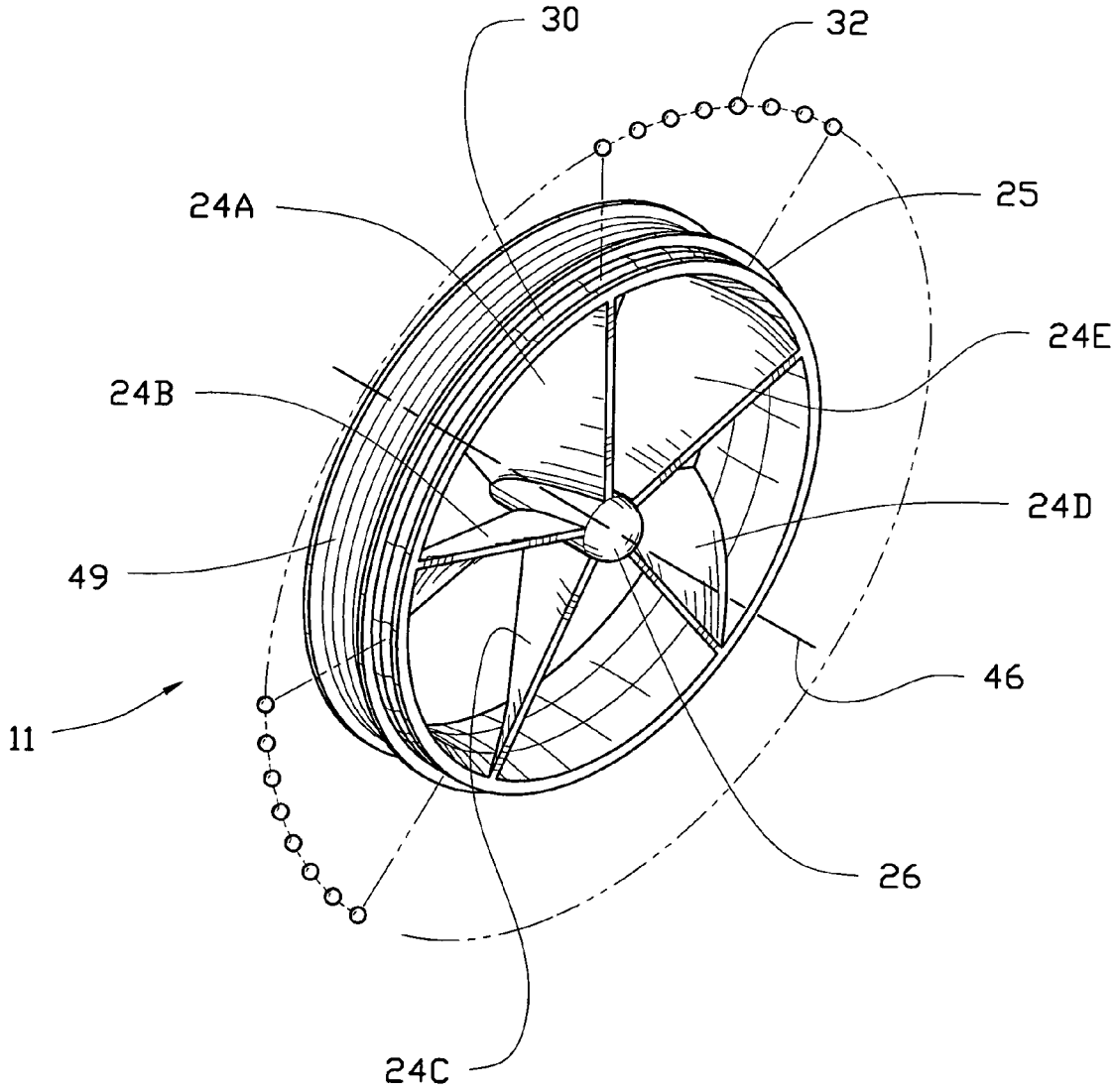
FIG. 7 is an isometric illustration of the propeller of the present invention.

The propeller 11, as best seen in FIG. 7, has a one piece construction comprising an annular shroud 25, which is specifically formed and devised on its periphery to make the propeller to function as a belt driven pulley, and a hub portion 26, which is coaxially disposed about the center axis 46 of the annular shroud 25. Within the annular space between the annular shroud 25 and the hub portion 26 are a set of propeller blades 24 (A-E) radially disposed about the center axis 46. The propeller blades 24 (A-E) are supported at the outer ends to the inner wall of the annular shroud 25 and at the inner ends to the hub portion 26 to create a singular unit propeller 11 with necessary strength and rigidity to serve as a driven pulley.

In the preferred embodiment, the drive belt 20 which transmits the torque generated by the motor 12 to the propeller 11 is a flexible belt of a type commonly used in modern automotive or marine engine accessory drive systems. Inside of the belt which engage with the pulleys is incorporated with a plurality of mini vee-bands 48 (best seen in FIG. 6) each disposed continuously along the entire length of the belt. These bands cooperate with a series of mating vee-grooves 49 on the periphery of the annular shroud 25 of the propeller 11 and a series of grooves 50 on the periphery of the drive pulley 21. A drive belt of this type is commonly referred to as "serpentine belt". It is obvious that any of the other type of flexible drive belts, such as a vee-belt, a cog-belt, a timing-belt, or any other power transmission belt in combination with corresponding mating means, or a chain, similar to those used in a bicycle power transmission system in combination with mating sprockets, will serve equally well for the purpose of the invention.

Figure 5:
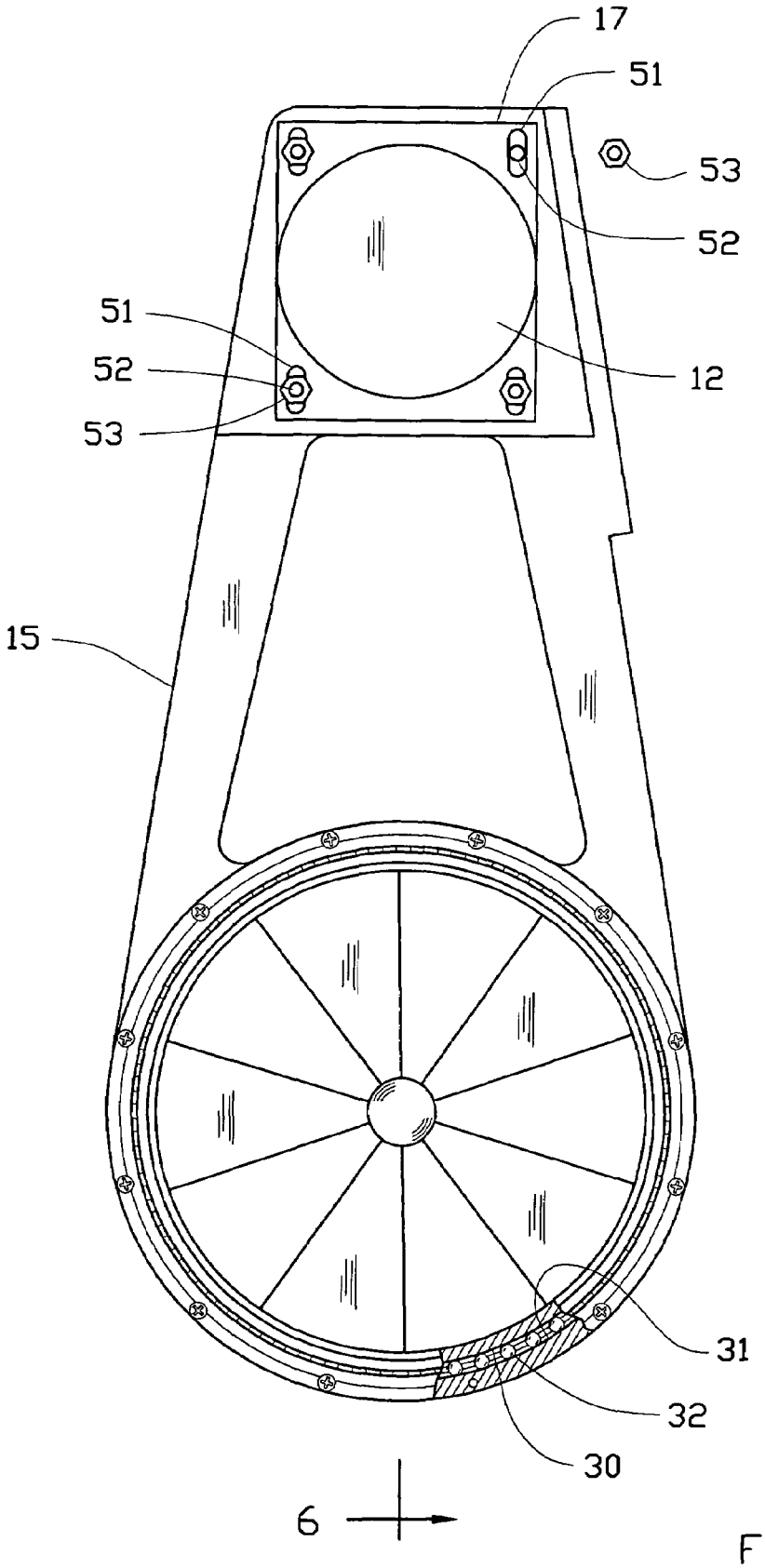
FIG. 5 is an exterior view of the thruster unit as viewed in the direction 5-5 established in FIG. 3. The lower portion of the casing is partially sectioned to better illustrate the propeller support bearing arrangement.
Figure 6:
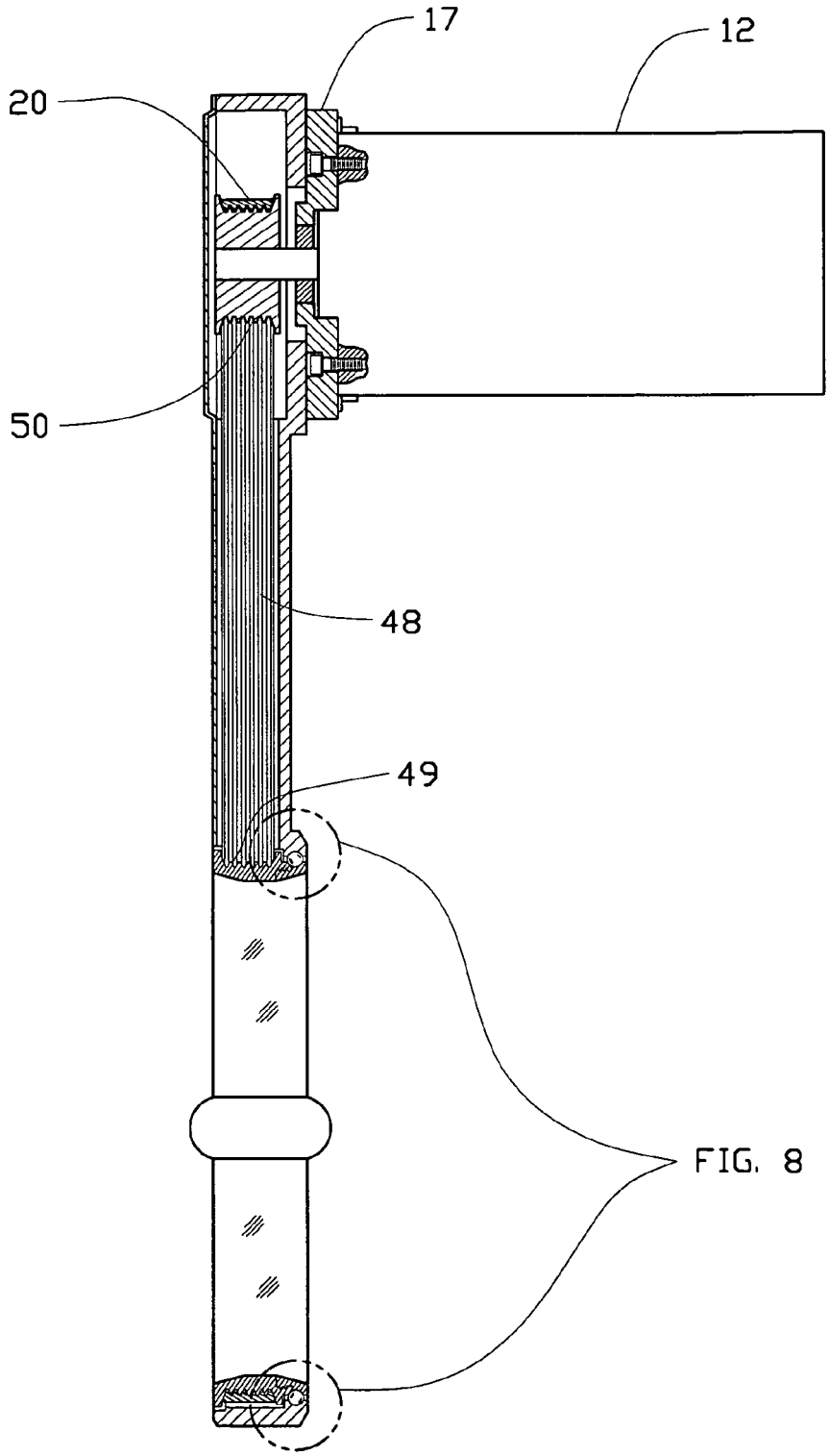
FIG. 6 is a cross section view of the thruster unit as viewed along the section plane 6-6 and in the direction established in FIG. 5.

Now, referring to FIG. 5 of the drawing, there are four slots 51 on the motor mount block 17 which enable a finite range of positional adjustability of the motor mount block with respect to the casing 15 along the vertical direction. The motor 12 is fixedly attached to the motor mount block and therefore the position of the drive pulley 21 is also adjusted as the motor mount block 17 is moved. Such relative positioning of the drive pulley with respect to the casing is used to adjust the drive belt tension. Once the belt tension is correctly adjusted, the motor mount block 17 is securely clamped onto the casing by four threaded studs 52 which are fixedly attached to the casing at one end, protruded through the slots 51, then mated and tightened at the opposite end with nuts 53. In FIG. 5, one of the four nuts 53 is shown removed from the stud to show the slot 51 more clearly. It is obvious that a different number of the slots, studs, and nuts may be employed and still achieve the same result.

Figure 8:
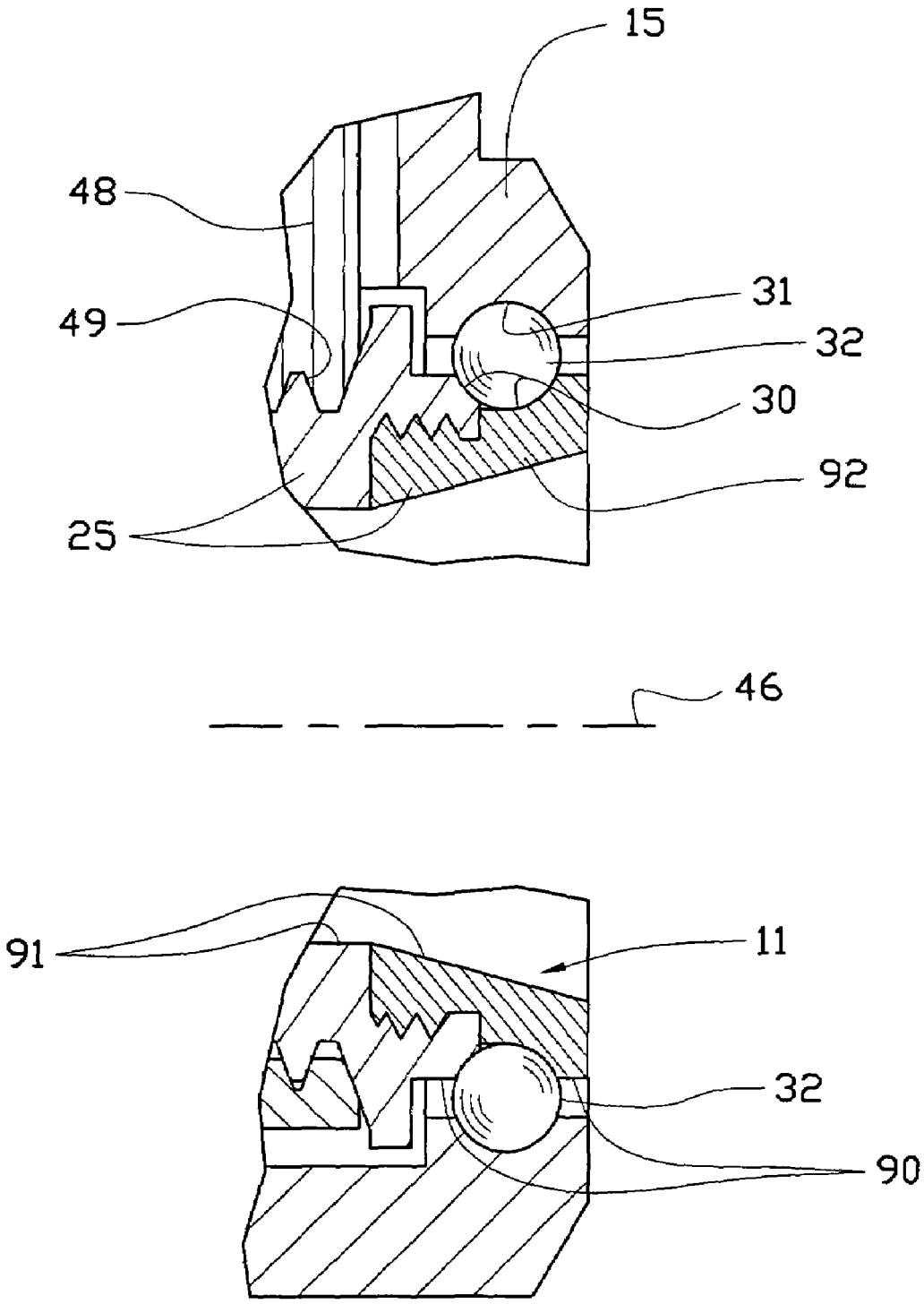
FIG. 8 is an enlarged detail of the propeller support bearing arrangement of the preferred embodiment of FIG. 6.

FIG. 8 shows an enlarged detail of a propeller support bearing arrangement of the preferred embodiment. The annular shroud 25 is shown to have an outer cylindrical wall 90 and an inner cylindrical wall 91. An outwardly facing groove 30 is provided on the outer cylindrical wall 90 of the annular shroud 25 of the propeller 11 and an opposing inwardly facing groove 31 is provided on the casing 15. These grooves serve as the inner and outer races for a series of rolling elements 32 to engage and roll thereon to form a rolling element bearing of a kind widely used in the modern machinery. To facilitate the assembly of the bearing arrangement, the propeller incorporates a retaining member 92 which may be separated from and reattached to the main body of the annular shroud of the propeller to allow insertion of the rolling elements 32. After the rolling elements are respectively positioned, the retaining member 92 is reattached. The preferred embodiment employs only one set of such bearing arrangement to make the transverse thickness, t (shown in FIG. 3), of the lower portion 13 at its narrowest possible width. One set of such bearing arrangement provides a sufficient support for the propeller 11 to freely rotate about the center axis 46 while preventing it from any lateral movement. However, it is obvious that another set or more of such bearing arrangements may be employed instead without departing from the scope of the invention, wherein the bearing sets may be grouped all on the same side of the propeller, or distributed among the two opposing sides of the propeller.

The thruster unit 10 may be installed on the stem 111 of a vessel as shown in FIG. 1 using a bow mounting bracket 61 and on the stern using a transom mounting bracket 62. Each of these brackets are respectively positioned and attached to the vessel using ordinary screws. These brackets are constructed out of sheet metal having some pliability or molded plastic having some elasticity such that the exact shape may be adjusted to fit the particular contour of the mounting surface to some degree.

The thruster unit may also be mounted on a swim platform of a vessel as shown in FIG. 2 using a platform mounting bracket assembly 63. The platform mounting bracket assembly as best seen in FIG. 4 comprises a bracket member 64 onto which the thruster unit is attached and a pair of hinge blocks 65 which is attached to the platform surface 66 using ordinary screws. The bracket member 64 further comprises a L-shaped portion 64A and a shaft portion 64B wherein the ends of the shaft portion are rotatably supported by the hinge blocks 65. This embodiment enables the thruster unit to be placed into the operating position 80 when in use and be pivoted up and out of the water in a position 81 to be stored dry on the platform when not in use.

Figure 10:
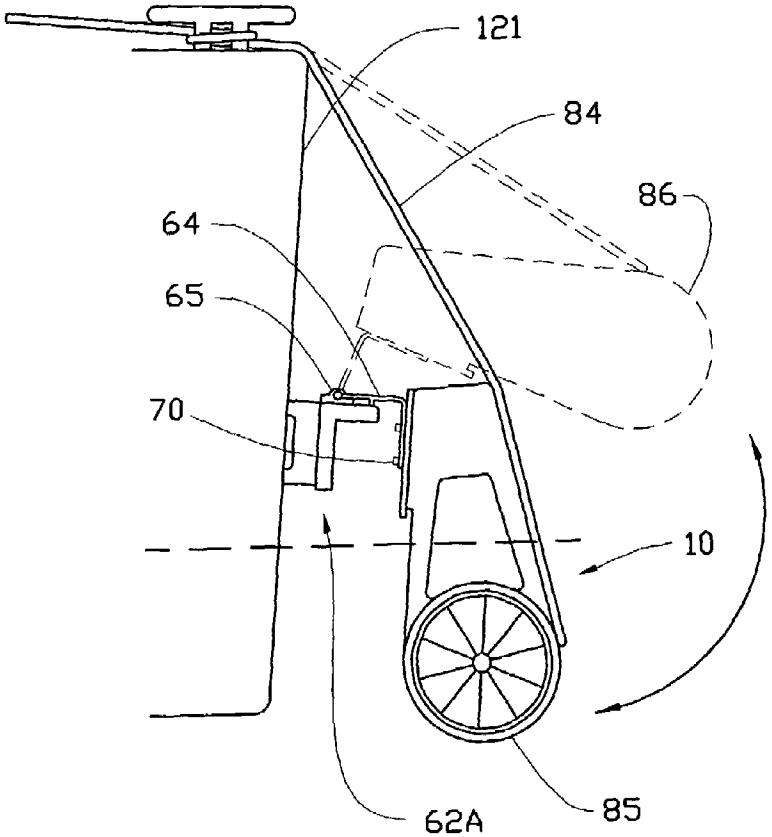
FIG. 10 is an enlarged detail of the stern section of a vessel similar to as shown in FIG. 1, except with the thruster unit of the present invention installed on the transom using a hinged transom mounting bracket.
Figure 9:
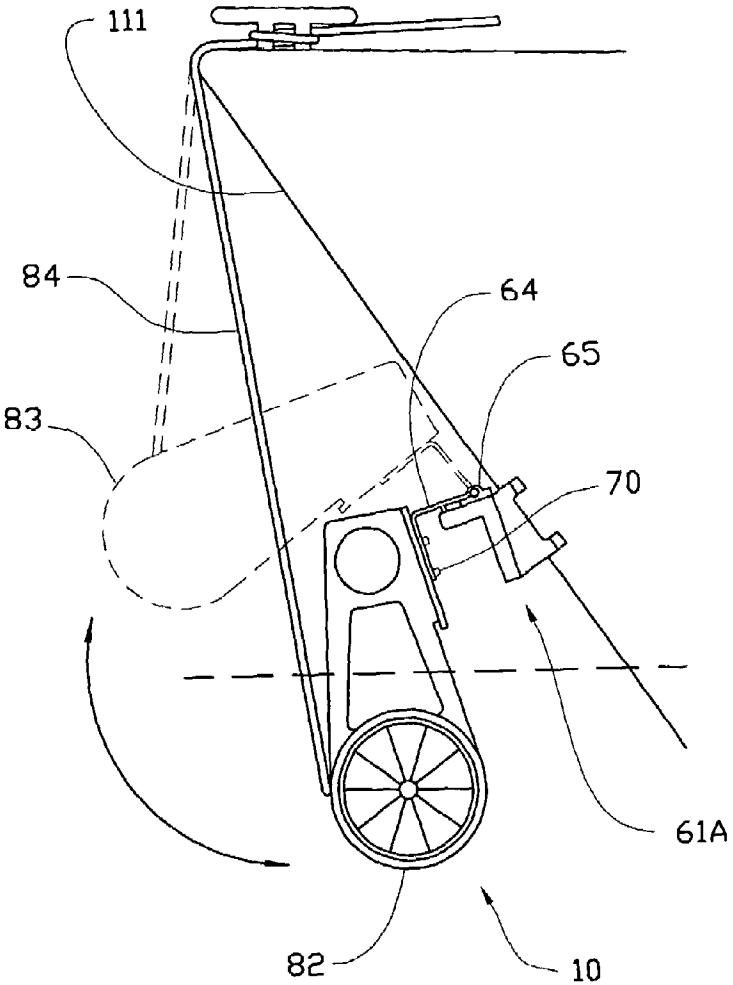
FIG. 9 is an enlarged detail of the bow section of the vessel as shown in FIG. 2 with the thruster unit of the present invention installed on the stem using a hinged bow mounting bracket.

The hinged arrangement of the platform mounting bracket assembly may readily be adapted into an alternate embodiment of the bow mounting bracket 61A as best seen in FIG. 2 and FIG. 9, wherein the thruster unit is mounted on the bracket member 64 and the hinge blocks 65 are attached directly to the main body of the bow mounting bracket to enable the thruster unit to be placed into the operating position 82 when in use and be pivoted up and out of the water to a position 83 for a dry storage. A cordage material 84 is used to pull on the thruster unit to move between the two positions and to secure the thruster unit in the storage position. It is equally feasible to adapt the same hinged bracket arrangement into an alternate embodiment of the transom mounting bracket 62A as best seen in FIG. 10. Herein, the hinge blocks 65 are directly attached to the main body of the transom mounting bracket to enable the thruster unit to be placed into the operating position 85 and be pivoted up and out of the water to a position 86 for a dry storage.

FIG. 4 shows the thruster unit 10 and the platform mounting assembly 63 detached from the thruster unit for clarity. The thruster unit includes an adapter plate 67 which is also shown detached from the thruster unit for clarity. The adapter plate 67 is attached to the thruster unit using screws 68 and has a series of threaded holes 69 equally spaced along the height of the plate. This allows the bracket member 64 to be attached to the adapter plate 67 using screws 70 at any of several positions as allowed by the threaded holes 69. This enables vertical positioning adjustment of the platform mounting assembly 63 with respect to the thruster unit 10. Such adjustability is necessary as the height of the swim platform above the waterline varies among boats.

Although the platform mounting assembly 63 is illustrated in FIG. 4, the same method of attaching the bracket onto the thruster unit is used with all of the above described bow mounting and transom mounting brackets of both the fixed and hinged embodiments. All of these brackets have the same set of holes with the same spacing as those holes 71 of the platform mounting assembly shown and are attached to the thruster unit 10 using the same screws 70. The same vertical adjustability is therefore possible with these other brackets which may be necessary for precise positioning of the thruster unit with respect to the waterline.

The thruster unit of the present invention is operated using a conventional power source, such as electric power, in case of an electric motor, or a hydraulic pressure, in case of a hydraulic motor. The thruster unit may be installed and operated at either the bow of the vessel to generate a lateral movement of the bow, which results in a similar but opposite lateral movement of the stern, or at the stern, to generate a lateral movement of the stern which results in a similar but opposite lateral movement of the bow. This enables the vessel to steer effectively at slow speeds or while moving in reverse by use of the lateral thruster when there is no significant effect produced by the rudder(s). In addition, two thruster units may be installed one at the bow and another at the stern and together operated in the same direction to propel the vessel sideways. Such lateral maneuvering is extremely helpful while docking into a tight space between two already docked vessels at a long dock, which is analogous to a situation involving parallel parking of automobiles. The electric voltage or the hydraulic fluid flow rate may be modulated to adjust the magnitude of thrust produced by the thruster unit and the polarity of the electric voltage or the direction of the hydraulic flow may be reversed to cause the reversal of the thrust direction.

The preferred means for generating the user input necessary to operate the thruster unit is a three-position, on-off-on, toggle switch of a type common in the art, which is spring-loaded returned to the middle, neutral, position when released. One such switch is used with each thruster unit and wired and positioned at the helm station to allow intuitive operation by the helmsman, such that right toggle movement results in the thrust generation toward the starboard side and the left toggle movement results in the thrust generation toward the port side. Use of a toggle switch will suffice where a single speed control of a fixed thrust magnitude is satisfactory, as such is the case for most small vessel applications. However, for larger vessels, or where variable magnitude thrust control is desirable, use of a joystick type input device in combination with a variable speed controller would be used. Such combination used in a variable speed control application is well known in the art.

Ease of servicing is an added benefit of the preferred embodiment. The thruster unit of the present invention may be safely and quickly removed from the vessel simply by removing the screws 70 and detaching the unit from the bracket while the vessel is at dock. Maintenance cleaning is also easy as the propeller 11 is readily accessible for cleaning from both starboard and port sides. The cleaning of the thruster unit of the invention may thus be performed using ordinary brushes and rags and as part of the vessel's scheduled periodic underwater hull cleaning process.

The present invention thus provides a thruster unit, which provides the user with a simple and inexpensive, yet reliable means for outfitting a vessel for superior maneuverability. The present invention may be installed on the hull of the vessel by a moderately skilled user using simple tools and the required operation performed above the waterline allowing the vessel to remain at dock while the installation is taking place. A unique design of the present invention allows for only the thin portion of the thruster unit to remain below the waterline and therefore allowing for a hydro-dynamically efficient operation. Also, contrary to those thrusters which are required to be retracted while the vessel is underway, the present invention may remain in the operating position at all times without risk of structural damage, therefore results in simpler mechanisms, higher mechanical reliability, and ease of operation.

Based upon the foregoing, one of ordinary skill in the art can readily practice the invention. Although an exemplary embodiments have been shown and described, it is believed that one of ordinary skill in the art may make changes, modifications, and substitutions without necessarily departing from the spirit and scope of the invention.

Additionally, the practice of the invention is not limited to making a standalone thruster unit, but may be integrated with vessel building practice such that the casing of the thruster unit is not made a separate part unique to the thruster, but rather a functional feature integrated into the hull design. This, in effect, would be same as having the casing of the thruster unit seamlessly molded right into the hull structure which would benefit the hydrodynamic efficiency of the overall vessel structure.

I claim:

1. A thruster unit adapted to be installed in an operating position about a bow, a stern, or a swim platform of a vessel having a waterline for generating thrust, said thruster unit comprising:

a substantially hollow casing having an upper portion and a lower portion, wherein said lower portion is situated below said waterline while said thruster unit is in said operating position;

a propeller disposed within said lower portion and having a rotating axis parallel to the direction of said thrust comprising (i) an annular shroud having an inner cylindrical wall and an outer cylindrical wall, and (ii) at least one propeller blade extending inwardly from said inner cylindrical wall;

a bearing means for supporting said propeller to rotate about said rotating axis while limiting axial movement thereof, said bearing means comprising (i) a radial-outwardly facing groove circumferentially disposed around said outer cylindrical wall of said annular shroud, (ii) a radial-inwardly facing groove in said lower portion of said casing, and (iii) a plurality of rolling elements disposed within the annular space between said radial-outwardly facing groove and said radial-inwardly facing groove and roll thereon said grooves as the propeller is rotated; and Said annular shroud of said propeller further comprising a removable retaining member attached thereon to jointly form said outwardly facing groove, wherein the retaining member is detachable from the annular shroud to allow said rolling elements easy access into and out of said annular space.

2. A thruster unit as recited in claim 1, further comprising:

a power generating means comprising (i) a mechanical power unit attached to said upper portion of said casing and having an output shaft and (ii) a rotary drive member disposed within said upper portion and driven by said output shaft;

a power transmitting means comprising a flexible drive member disposed within said casing and trained around both said rotary drive member and said annular shroud of said propeller for transmitting the mechanical power from said power generating means to said propeller to cause the propeller to rotate about said rotating axis; and a tension adjusting means for said flexible drive member, said tension adjusting means comprising (i) said mechanical power unit adapted for relative positioning with respect to said casing within a range, wherein an adjustment of said relative positioning results in either increasing or decreasing tension in said flexible drive member and (ii) a means for securing said mechanical power unit at any position within said range of said relative positioning.

* * * * *